US007798044B2

(12) United States Patent
Webb

(10) Patent No.: US 7,798,044 B2
(45) Date of Patent: Sep. 21, 2010

(54) WEAPON SYSTEM

(75) Inventor: Michael J. Webb, Barrow-in-Furness (GB)

(73) Assignee: BAE Systems PLC, London (GB)

( * ) Notice: Subject to any disclaimer, the term of this patent is extended or adjusted under 35 U.S.C. 154(b) by 0 days.

(21) Appl. No.: 12/090,911

(22) PCT Filed: Oct. 27, 2006

(86) PCT No.: PCT/GB2006/050359

§ 371 (c)(1),
(2), (4) Date: Apr. 21, 2008

(87) PCT Pub. No.: WO2007/049079

PCT Pub. Date: May 3, 2007

(65) Prior Publication Data

US 2008/0250915 A1 Oct. 16, 2008

(30) Foreign Application Priority Data

Oct. 29, 2005 (EP) ..... 05256704
Oct. 29, 2005 (GB) ..... 0522085.0

(51) Int. Cl.
*F41A 13/06* (2006.01)

(52) U.S. Cl. ..... 89/1.2

(58) Field of Classification Search ..... 42/96; 89/1.2

See application file for complete search history.

(56) References Cited

U.S. PATENT DOCUMENTS

| | | | | |
|---|---|---|---|---|
| 790,664 | A | 5/1905 | Smith | |
| 1,055,823 | A * | 3/1913 | Smith | 89/1.2 |
| 4,024,790 | A | 5/1977 | Heiderer | |
| 5,511,456 | A | 4/1996 | Faughn | |
| 5,911,568 | A * | 6/1999 | Kirschner et al. | 42/1.14 |

FOREIGN PATENT DOCUMENTS

FR 1 081 766 12/1954

OTHER PUBLICATIONS

International Search Report issued in PCT/GB2006/050359, Feb. 6, 2008, 3 pages.
International Preliminary Report on Patentability issued in PCT/GB2006/050359, Feb. 6, 2008, 9 pages.

* cited by examiner

*Primary Examiner*—Stephen M Johnson
(74) *Attorney, Agent, or Firm*—Pillsbury Winthrop Shaw Pittman LLP

(57) ABSTRACT

A weapon system comprising a barrel for accommodating a projectile in a breech end portion, a muzzle end portion and a breech. The weapon system further comprises means for purging the barrel comprising a coanda slot, a coanda profile provided downstream of the coanda slot, and a source of pressurized gas, a duct which connects the source of pressurized gas to the coanda slot so that pressurized gas can be selectively supplied to the coanda slot and along the coanda profile, thereby entraining air in the barrel and exhausting debris and/or fumes through the muzzle end portion after firing of a projectile, and a valve for controlling flow of gas through the duct.

13 Claims, 5 Drawing Sheets

WEAPON SYSTEM

CROSS REFERENCE TO RELATED APPLICATIONS

This is the U.S. National Phase of PCT/GB2006/050359, filed Oct. 27, 2006, which claims priority to British Application No. 0522085.0, filed Oct. 29, 2005, and European Application No. 05256704.7, filed Oct. 29, 2005, both of which are incorporated herein in their entirety by reference.

The present invention relates to a weapon system comprising means for purging the barrel of the weapon system of debris and/or fumes after firing.

Debris and fumes remain in a gun barrel of a weapon system after a projectile is fired, and it is desirable to remove the debris and fumes prior to further use of the system. Several weapon systems are know hereto which allow purging of the barrel of the weapon system of debris and/or fumes after firing. The known arrangements can be broadly classified into active and passive purging means.

In one such known passive system, an accumulator chamber is provided adjacent the gun barrel for storing a portion of the high pressure combustion gasses after firing. When the projectile is fired from the barrel, the gasses in the accumulator chamber are vented into the gun barrel as the barrel pressure drops below the chamber pressure. The gasses are vented through oblique passages in the gun barrel forming a jet which entrains air/fumes and smaller debris. The entrained air is proportional to the surface area of the jet and the number of passages, and the amount of fumes and debris which can be purged by this method is limited because the number of passages and size of their orifices adversely affect the life of the gun barrel. Therefore, this prior art arrangement is not considered a satisfactory solution to the problem of gun barrel purging.

In known active purging means, compressed gas can be vented through the barrel to purge it of fume and debris. Whilst this solution is acceptable in terms of clearing the gun barrel, it is inefficient and therefore involves the use of significant quantities of gas and the burden of carrying numerous and/or large compressed gas cylinders with the weapon system.

U.S. Pat. No. 4,024,790 discloses a passive purging means for a weapon system. A housing comprising an accumulator chamber is provided at the muzzle end of a gun barrel and an annular slot allows passage of combustion gasses between the gun barrel and the accumulator chamber. When a projectile is fired, and has passed the annular slot, combustion gasses are forced through the slot and accumulate in the chamber. When the projectile exits the gun barrel, the barrel pressure reduces until it is lower than the accumulator pressure. At this point, the combustion gasses are vented through the slot, along a coanda profile defined by an internal bore of the housing and exhaust into ambient air though an end aperture. The coanda profile produces a generally cylindrical gas stream which adheres to the surface of the profile and which is effective in entraining relatively large quantities of air. Thus, venting of the combustion gasses in this way provides an improvement over the prior art passive system referred to above.

There are however a number of drawbacks with the system disclosed in U.S. Pat. No. 4,024,790. The accumulation of air in the chamber occurs over a very small period of time, between the instant when the projectile passes the annular slot and the instant when the muzzle gas pressure decays to the ambient atmospheric pressure. Thus, the maximum available pressure (and volume) in the chamber is relatively low, therefore the duration of exhaust is short and the amount of gas entrained and exhausted through the gun tube is relatively low. It is disclosed that the pressure in the accumulator chamber may be supplemented by an auxiliary pressure source, but the use of such an auxiliary pressure source leads to gasses being continually vented through the annular slot and this results in the consumption of large quantities of gas. As this method utilises the flow of the entrained gasses in the barrel (rather than the accumulated gasses) to extract fumes and debris, it is essential that the receiver (on small calibre systems) or Breech (on large calibre gun systems) is open to allow gas flow through the gun tube. Therefore due to the passive nature of this arrangement, the receiver/breech must be opened at the exact moment that the gun pressure decays to ambient atmospheric pressure. Although U.S. Pat. No. 4,024,790 claims to be relevant to small and large calibre guns, the requirement to open the Breech on large calibre gun systems at the required time is unachievable. Typically the breech of a large calibre gun opens later in the firing sequence than the receiver of a smaller calibre gun and this would prevent the method described in U.S. Pat. No. 4,024,790 from working effectively. The method according to U.S. Pat. No. 4,024,790 is described in more detail with reference to FIG. 2, for comparison purposes.

It is an object of the invention to provide a weapons system with improved means for purging the barrel thereof of fumes and/or debris.

The present invention provides a weapon system comprising: a barrel for accommodating a projectile in a breech end portion thereof prior to firing and having a muzzle end portion out of which a projectile can be fired; a breech for closing the breech end portion of the barrel when a projectile is accommodated in the breech end portion and for opening the breech end portion after a projectile has been fired; means for purging the barrel comprising a coanda slot; a coanda profile provided downstream of the coanda slot; a source of pressurised gas; a duct which connects the source of pressurised gas to the coanda slot so that pressurised gas can be selectively supplied to the coanda slot and along the coanda profile thereby entraining air in the barrel and exhausting debris and/or fumes through the muzzle end portion after firing of a projectile; and a valve for controlling flow of gas through the duct.

Advantageously, the system comprises a control means for monitoring a firing sequence and for controlling the valve to allow pressurised gas through the duct at a predetermined time in the firing sequence.

The coanda slot may be provided at the muzzle end portion of the barrel.

In this case, the coanda slot may be formed at least partially by a housing which is fitted at the muzzle end portion of the barrel.

Alternatively, the coanda slot may be provided at the breech end portion of the barrel.

In this alternative, a breech ring may form at least a portion of the coanda slot.

If the coanda slot is provided at the breech end portion of the barrel, the coanda slot and coanda profile can be isolated from the interior of the barrel during firing of a projectile.

The present invention also provides a method of purging a barrel of a weapon system, the weapon system comprising: a barrel for accommodating a projectile in a breech end portion thereof prior to firing and having a muzzle end portion out of which a projectile can be fired; a breech for closing the breech end portion of the barrel when a projectile is accommodated in the breech end portion and for opening the breech end portion after a projectile has been fired; and means for purging the barrel comprising a coanda slot; a coanda profile provided downstream of the coanda slot; and a source of pressurised gas; wherein the method comprises monitoring a firing sequence of the weapon system and supplying pressurised gas to the coanda slot and along the coanda profile at a predetermined time in the firing sequence thereby entraining air in the barrel and exhausting debris and/or fumes through the muzzle end portion after firing of a projectile.

Purging of the barrel preferably occurs generally when the breech end portion is open.

Pressurised gas may be supplied at a predetermined time in the firing sequence prior to the breech end portion being opened to reduce pressure in the barrel so that when the breech end portion is opened ambient air enters the barrel through the breech end portion which decreases the amount of fumes and/or debris which exhaust through the breech end portion.

In order that the present invention may be well understood some embodiments thereof, which are given by way of example only will now be described with reference to the accompanying drawings, in which.

Figure 1:
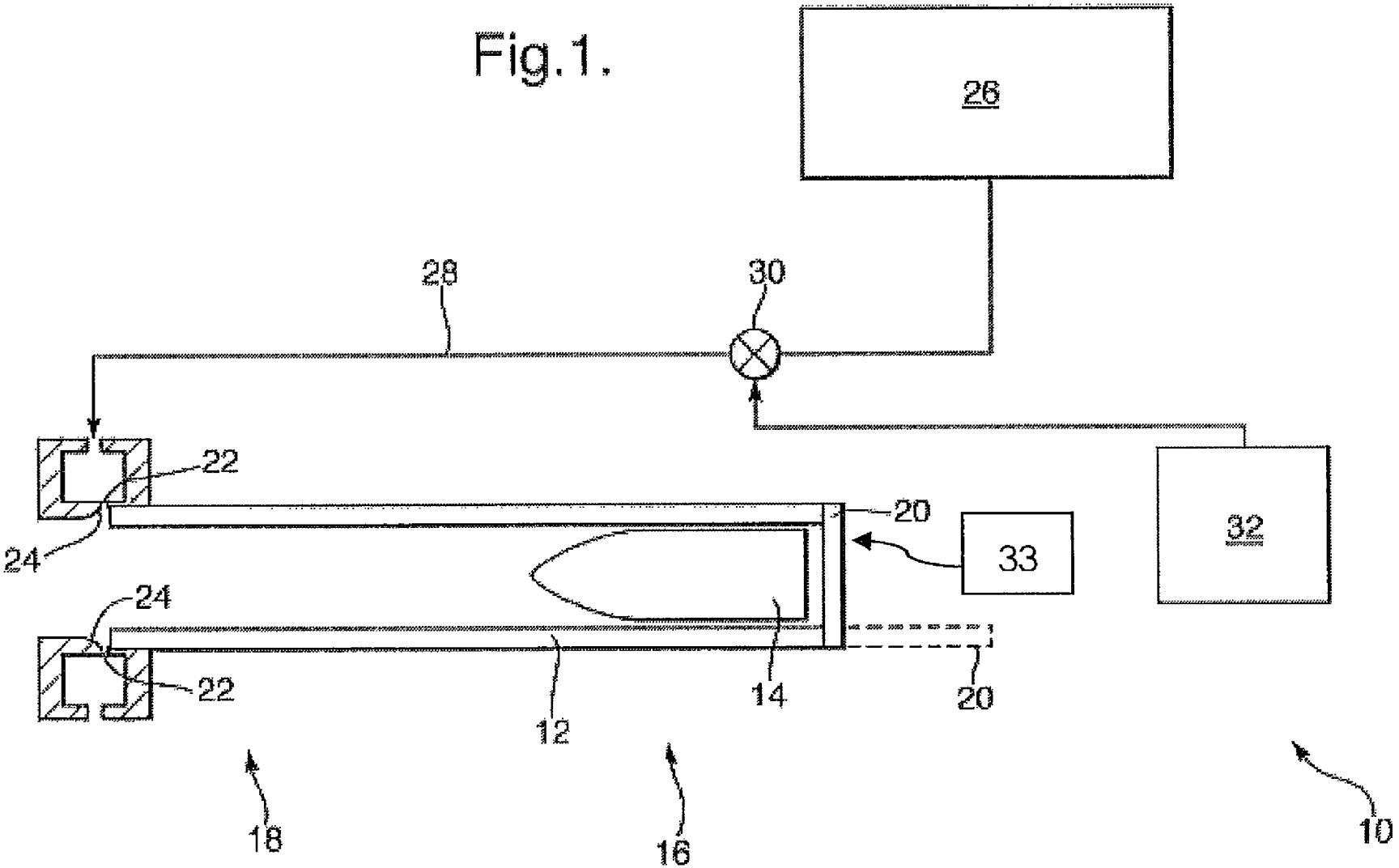
FIG. 1 is a schematic representation of a weapon system.

Referring to FIG. 1, a weapon system is shown generally at 10 and comprises: a barrel 12 for accommodating a projectile 14 in a breech end portion 16 thereof prior to firing and having a muzzle end portion 18 out of which the projectile 14 can be fired; a breech block 20 for closing the breech end portion 16 of the barrel 12 when the projectile is accommodated in the breech end portion and for opening the breech end portion 16 after the projectile has been fired. The breech block 20 is shown in solid lines in FIG. 1 in the closed condition and in phantom lines in the open condition. The weapon system further comprises means for purging the barrel comprising a coanda slot 22; a coanda profile 24 provided downstream of the coanda slot; a source of pressurised gas 26; a duct 28 which connects the source of pressurised gas to the coanda slot 22 so that pressurised gas can be selectively supplied to the coanda slot 22 and along the coanda profile 24 thereby entraining air in the barrel 12 and exhausting debris and/or fumes through the muzzle end portion 18 after firing of a projectile 14; and a valve 30 (or any other suitable flow control means) for controlling flow of gas through the duct 28. The behaviour of the pressurised gas and operation of the purging sequence will be described in more detail below with reference to FIGS. 2 to 5.

Figure 2:
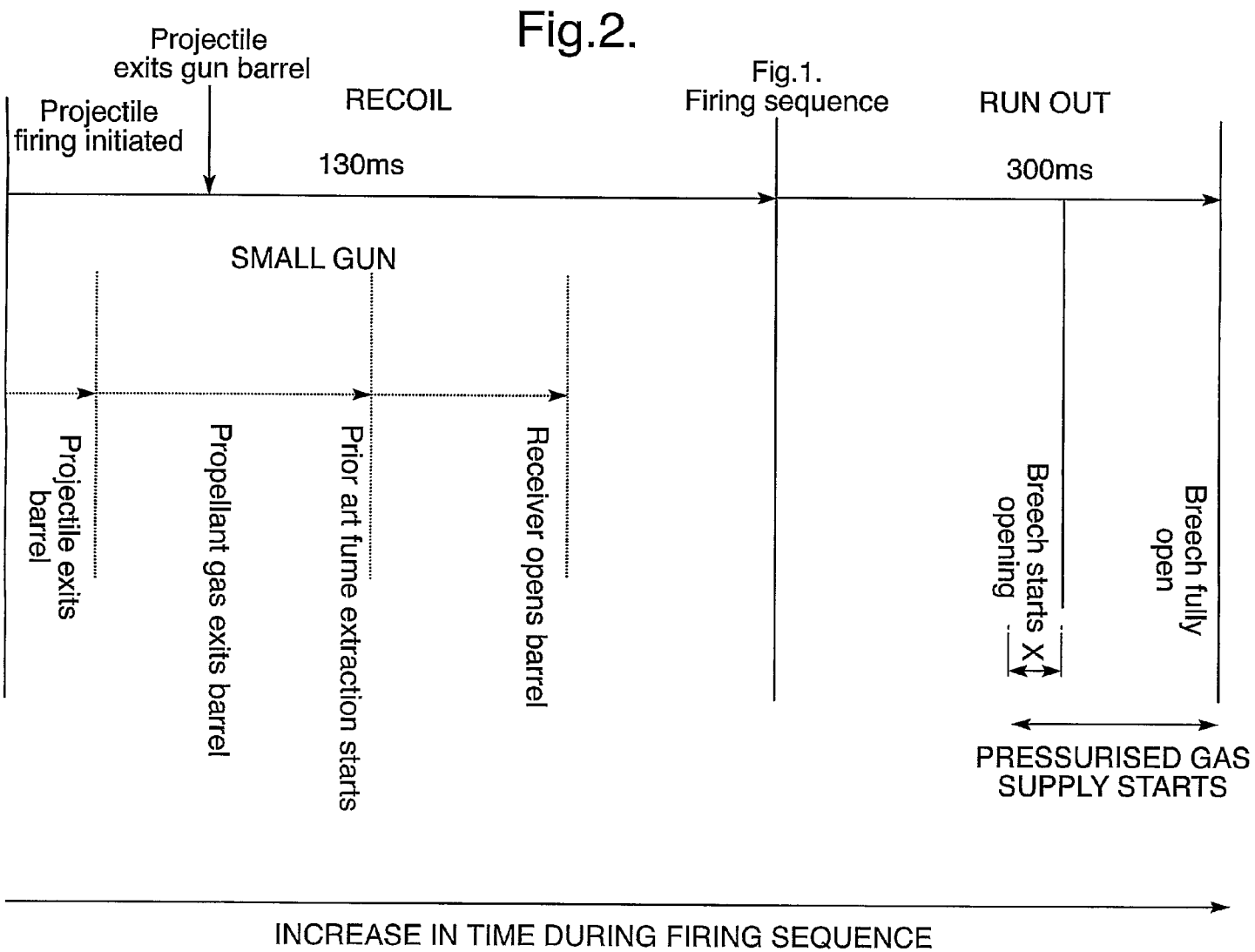
FIG. 2 is a representation showing a comparison in the firing sequence of a small calibre gun with that of a large calibre gun.

The weapon system comprises control means 32 for monitoring a firing sequence and for controlling the valve 30 to allow pressurised gas through the duct 28 at a predetermined time in the firing sequence. Preferably, the valve is opened at a predetermined time prior to the breech end portion being opened. FIG. 2 describes the firing sequence in more detail. The sequence starts with initiation of projectile firing at time '0'. The firing sequence of a small gun using the weapon system as disclosed in U.S. Pat. No. 4,024,790 is shown in phantom lines for comparison.

Upon initiation of the firing sequence of the weapon system shown in FIG. 1, the propellant of the projectile produces combustion gasses causing barrel pressure to rise. The projectile is forced along the barrel and the barrel recoils in reaction thereto. As an example, the projectile exits the barrel at time X and the total time taken for the barrel to recoil is 130 ms. Barrel pressure reduces when the projectile is fired from the barrel and when the pressure is reduced to ambient pressure, the breech block 20 is opened. Usually the breech block 20 is opened automatically, generally during run out of the barrel. Control means 32 monitors the firing sequence and preferably opens duct 30 at a predetermined time prior to breech opening, as shown in FIG. 2. Sensing means may be provided for sensing when said breech block 20 is opened, such that pressurised gas is supplied to the coanda slot dependent on when said breech block 20 is opened. For instance, in one embodiment as shown, a sensor 33 may be provided for sensing when the breech block 20 is about to be opened, for instance by manual operation of a breech lever, and for sending the sensed signal to the control means 32. Alternatively, the firing sequence can be programmed into the control means which opens the duct 30 at a predetermined time into the firing sequence.

Initiating the purging process just prior to breech opening reduces the amount of fume and/or debris which exhausts through the breech end portion. In more detail, pressurised gas is vented through coanda slot 22 thereby entraining air/gasses in the barrel and exhausting them through the muzzle end portion. Hence, the barrel pressure is reduced so that when the breech block 20 is opened, fume and/or debris do not exhaust through the breech end portion 16, but instead, ambient air enters through the breech end portion 16 forcing the fume and/or debris towards the muzzle end portion 18. Continued venting of gas through the coanda slot during the time which the breech block 20 is in the process of opening causes purging of the barrel of fume and/or debris, without allowing any fume and/or debris to exhaust through the breech end portion 16, which could otherwise be hazardous to artillery personnel, or tank crews, as the case may be. The purging process is timed to start so that barrel pressure is reduced sufficiently to reduce significant fume and/or debris exhausting through the breech end portion 16.

Alternatively, pressurised gas can be vented through coanda slot 22 at the same time as the breech block 20 begins to open whilst still preventing back flow of fume and/or debris thought the breech end portion 16. Optionally, pressurised gas can be vented through coanda slot 22 after the breech block 20 begins to open, but this is not currently preferred since some fume and/or debris may exit through the breech end portion 16.

FIG. 2 also shows a firing sequence for a small calibre gun as in prior art document U.S. Pat. No. 4,024,790, for comparison purposes. The prior art fume extractor commences operation after the projectile has exited the barrel and after sufficient propellant gases have been exhausted so that barrel pressure drops to ambient atmospheric pressure. However, the receiver does not open the barrel in a small gun until after the accumulator chamber has vented the accumulated gas. Therefore, back pressure in the barrel resists purging of fume from the barrel, although the problem of this back pressure is partially alleviated by the provision of a small vent aperture at the receiver end of the barrel. The prior art fume extractor may be acceptable for such rapid fire small guns, where the pressure in the barrel on firing is relatively low and does not lead to dangerous venting of combustion gases through the vent aperture. Further, projectiles may be fired at up to 300 per minute and therefore an active system of purging is not practical. Still further, small guns of this type typically do not produce significant amount of debris, and the problem of purging the barrel of debris is not relevant with the prior art extractor.

The method by which the coanda slot 22 and profile 24 operates in the weapon system of FIG. 1 will now be described in more detail with reference to FIGS. 3 and 4.

Coanda ring jets are known in the art and have the ability to entrain large volumes of air from a relatively small supply air flow. In the present application, a relatively thin circumferential slot is provided though which a high pressure jet of air is vented normal to the axis of an internal bore of the gun barrel. The slot is designed so that the jet detaches on one side and follows a coanda profile on the other, which redirects the jet to flow parallel to the bore axis attached to the bore surface.

Figure 3:
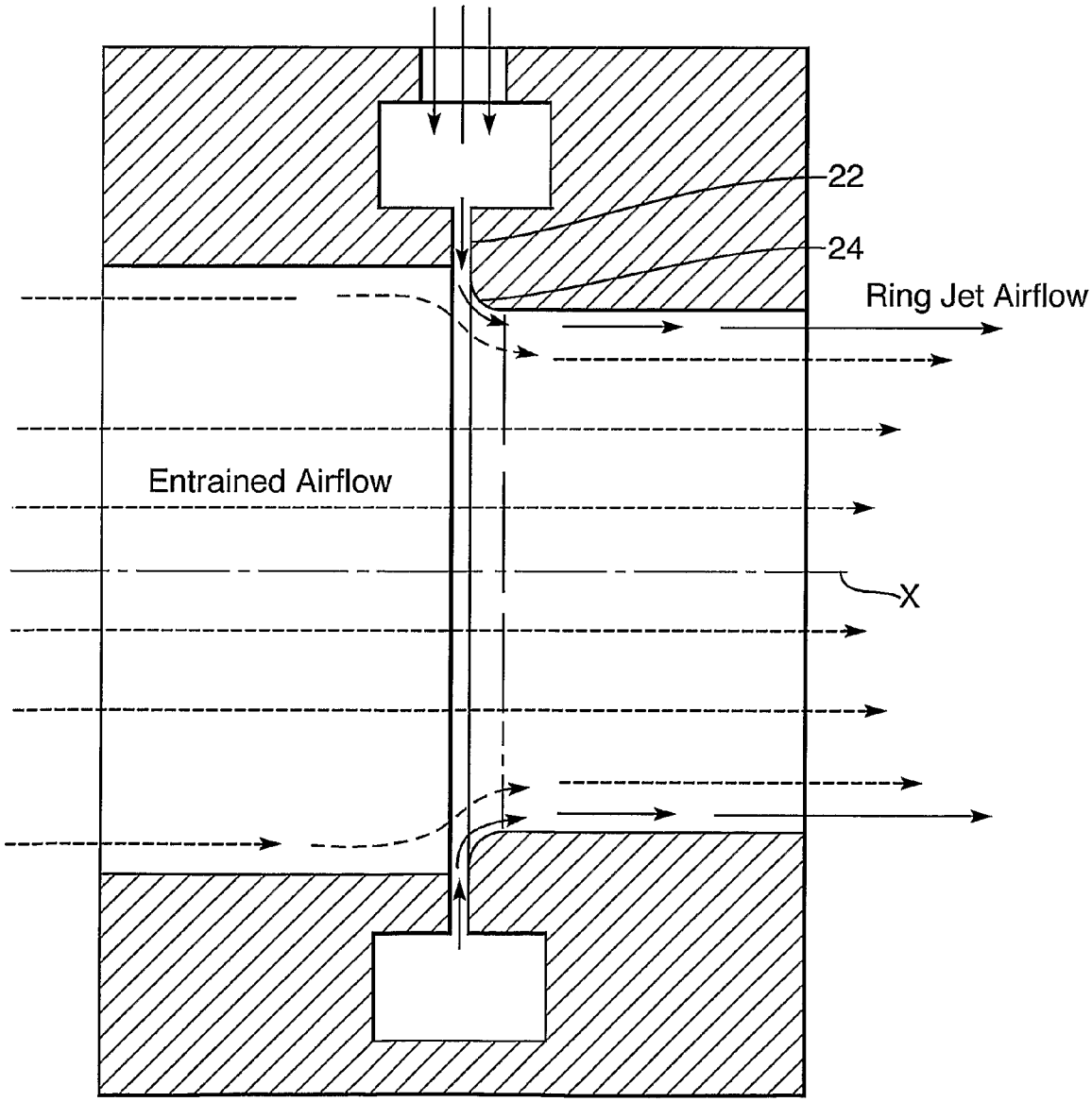
FIG. 3 is cross-section taken along an axis of the gun barrel in FIG. 1 showing in more detail the means for purging the barrel of fume and/or debris.

FIG. 3 shows the ring jet air flow in solid arrows. The entrained air is shown in broken arrows. The ring jet air flow becomes a thin tube of air moving along the inside of the bore. Since the tube of air has a large surface area the amount of air entrainment is extremely high, typically with ratios of 20:1, entrained air: input air volume.

Figure 4:
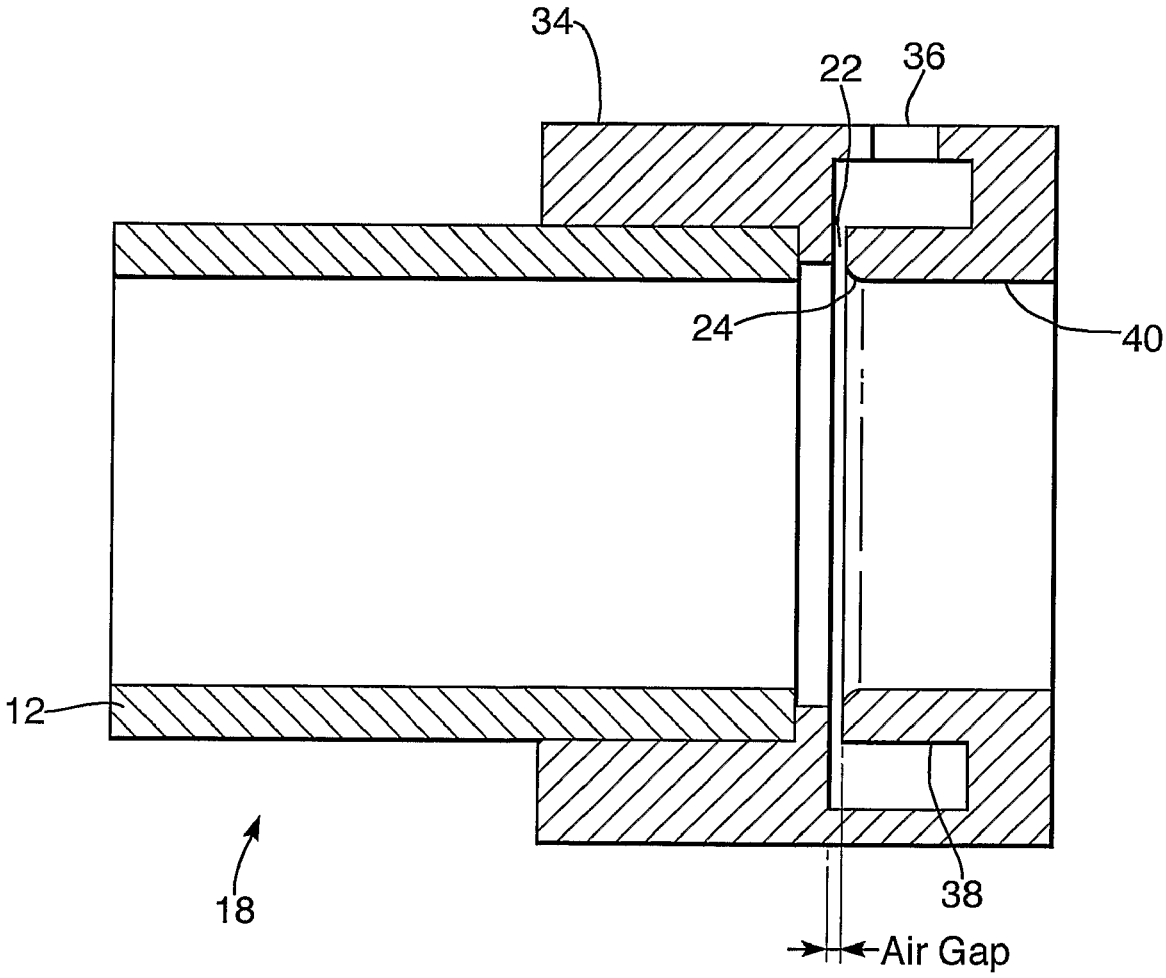
FIG. 4 is a similar cross-section to FIG. 3 showing the purging means at a muzzle end portion of the barrel.
Figure 5:
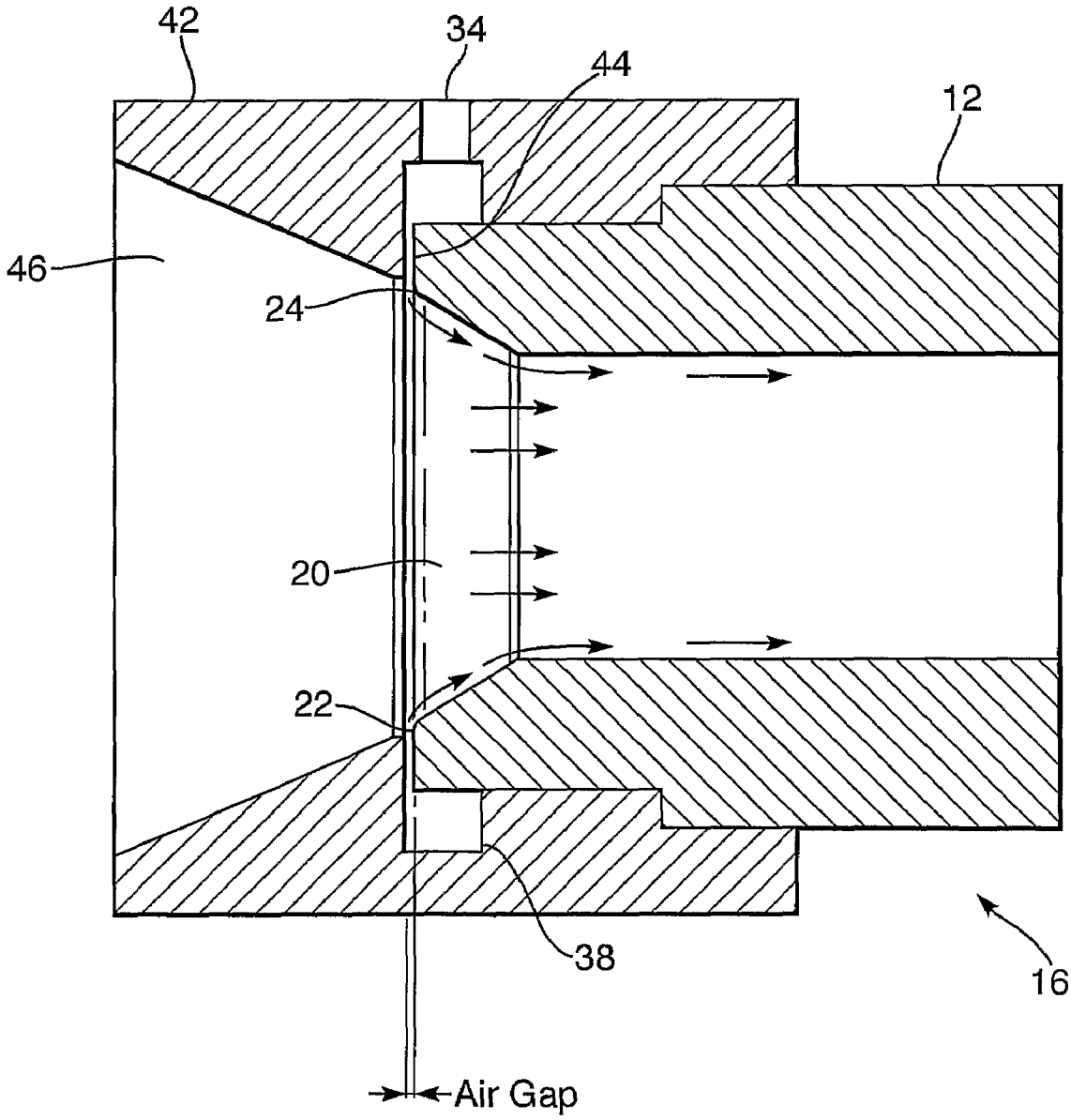
FIG. 5 is a similar cross-section to FIG. 3 showing the purging means at a breech end portion of the barrel.

FIG. 4 shows a housing mounted at the muzzle end portion 18 of the barrel 12, similar to the muzzle mounted arrangement shown in FIG. 1. The housing 34 is mounted to the muzzle end portion 18 of a gun barrel 12 in any suitable manner, for instance by complimentary threading on the external surface of the barrel and internal surface of the device. Pressured air from duct 28 enters the housing through air inlet 36 and is circulated through a circumferential air chamber 38. During purging of the gun barrel 12, pressurised gas is introduced to chamber 38 and is vented through coanda slot 22 which typically has a typical width of 0.05 to 0.20 mm. The coanda profile 24 guides the pressurised air to flow along the internal surface 40 of the housing entraining large volumes of air from within the barrel. Air/fumes/debris are exhausted through an end aperture of the housing.

Alternatively, the purging arrangement can be situated at the breach end portion 16 of the barrel 12 and incorporated with a breach ring 42. The air inlet 34 and circumferential chamber 38 are provided in the breach ring 42. The coanda slot 22 is provided between an end surface 44 of the barrel 12 and an end surface 46 of the breach ring 42. The coanda profile 24 is formed by an appropriately shaped portion of the gun barrel 12. During firing, the breech block 20 is positioned as shown and occludes coanda slot 22 and therefore isolates the slot from the combustion gases generated during firing. As the breech block 20 is opened following firing, pressurised gas is introduced through air inlet 34 into chamber 38 and through slot 22 and long profile 24, thereby entraining air in the barrel and purging the barrel of fume and/or debris.

The breach mounted arrangement has the advantage that the coanda slot and pressurised gas system is isolated from the combustion gases during firing. Whereas, the breach mounted system has the advantage that it can be readily be retro fitted to an existing weapon system.

The invention claimed is:

1. A weapon system comprising:

a barrel for accommodating a projectile in a breech end portion thereof prior to firing and having a muzzle end portion out of which said projectile can be fired;

a breech block for closing the breech end portion of the barrel when said projectile is accommodated in the breech end portion and for opening the breech end portion after said projectile has been fired; and a device for purging the barrel comprising: a slot through which pressurised gas flows radially inwardly into the barrel; a profile shaped to incur the coanda effect, the profile provided downstream of the slot, the profile curving in a direction towards the muzzle end portion so as to direct the flow of the pressurised gas from the slot into the barrel outwardly through the muzzle end portion; a source of pressurised gas; and a duct which connects the source of pressurised gas to the slot so that pressurised gas can be selectively supplied to the slot and along the profile thereby entraining air in the barrel and exhausting debris and/or fumes outwardly through the muzzle end portion after firing of said projectile;

wherein the weapon system further comprises a sensor for sensing when said breech block is opened, wherein said pressurized gas can be supplied to the slot dependent on when said sensor senses that said breech block is opened.

2. A weapon system as claimed in claim 1, wherein the slot is provided at the muzzle end portion of the barrel.

3. A weapon system as claimed in claim 2, wherein the slot is formed at least partially by a housing which is fitted at the muzzle end portion of the barrel.

4. A weapon system as claimed in claim 1, wherein the slot is provided at the breech end portion of the barrel.

5. A weapon system as claimed in claim 4, wherein a breech ring forms at least a portion of the slot.

6. A weapon system as claimed in claim 4, further comprising a structure that isolates the slot and profile from the interior of the barrel during firing of the projectile.

7. A weapon system as claimed in claim 1, wherein the device for purging the barrel further comprises a valve for controlling flow of gas through the duct.

8. A weapon system as claimed in claim 7, comprising a controller for monitoring a firing sequence and for controlling the valve to allow pressurised gas through the duct at a predetermined time in the firing sequence.

9. A weapon system as claimed in claim 1, wherein the slot is spaced axially from the breech block.

10. A method of purging a barrel of a weapon system, the weapon system comprising:

a barrel for accommodating a projectile in a breech end portion thereof prior to firing and having a muzzle end portion out of which said projectile can be fired;

a breech block for closing the breech end portion of the barrel when said projectile is accommodated in the breech end portion and for opening the breech end portion after a projectile has been fired; and a device for purging the barrel comprising a slot through which pressurised gas flows radially inwardly into the barrel; a profile shaped to incur the coanda effect, the profile provided downstream of the slot, the profile curving in a direction towards the muzzle end portion so as to direct the flow of the pressurised gas from the slot into the barrel outwardly through the muzzle end portion; and a source of pressurised gas, wherein said pressurised gas can be supplied to the slot dependent on when said breech block is opened;

the method comprising:

monitoring a firing sequence of the weapon system; and supplying pressurised gas to the slot and along the profile at a predetermined time in the firing sequence, thereby entraining air in the barrel and exhausting debris and/or fumes outwardly through the muzzle end portion after firing of a projectile.

11. A method as claimed in claim 10, wherein a sensor senses when said breech block is opened, and said pressurised gas is supplied to the slot dependent on when said sensor senses that the breech is opened.

12. A method as claimed in claim 11, wherein purging of the barrel occurs generally when the breech end portion is open.

13. A method as claimed in claim 12, wherein pressurised gas is supplied at a predetermined time in the firing sequence prior to the breech end portion being opened to reduce pressure in the barrel so that when the breech end portion is opened ambient air enters the barrel through the breech end portion which decreases the amount of fumes and/or debris which exhaust through the breech end portion.

* * * * *